US008979210B2

(12) United States Patent
Tan et al.

(10) Patent No.: US 8,979,210 B2
(45) Date of Patent: Mar. 17, 2015

(54) LIQUID COLLECTION PROCESS WITH LIQUID GUIDING HOLES FOR IN-SITU LEACHING AN ORE BODY TO EXTRACT RARE EARTH ELEMENTS

(75) Inventors: Yaofeng Tan, Jiangxi (CN); Yan Liu, Jiangxi (CN); Guoqing Deng, Jiangxi (CN); Xiaolin He, Jiangxi (CN)

(73) Assignee: Jiangxi Rare Earth & Rare Metals Tungsten Group Holding Co., Ltd., Jiangxi (CN)

( * ) Notice: Subject to any disclaimer, the term of this patent is extended or adjusted under 35 U.S.C. 154(b) by 32 days.

(21) Appl. No.: 13/814,121

(22) PCT Filed: Aug. 2, 2011

(86) PCT No.: PCT/CN2011/077909

§ 371 (c)(1),
(2), (4) Date: Feb. 26, 2013

(87) PCT Pub. No.: WO2012/016514

PCT Pub. Date: Feb. 9, 2012

(65) Prior Publication Data

US 2013/0154338 A1 Jun. 20, 2013

(30) Foreign Application Priority Data

Aug. 3, 2010 (CN) ..... 2010 1 0247785

(51) Int. Cl.
*E21B 43/28* (2006.01)

(52) U.S. Cl.
CPC ..... *E21B 43/28* (2013.01)
USPC ..... 299/5

(58) Field of Classification Search
CPC ..... E21B 43/28
USPC ..... 299/5
See application file for complete search history.

(56) References Cited

U.S. PATENT DOCUMENTS

| | | | | |
|---|---|---|---|---|
| 2,200,665 | A * | 5/1940 | Bolton | 299/5 |
| 2,682,396 | A * | 6/1954 | Haworth | 299/5 |
| 4,285,548 | A * | 8/1981 | Erickson | 299/2 |
| 5,690,390 | A * | 11/1997 | Bithell | 299/5 |
| 2013/0200681 | A1 * | 8/2013 | Tan et al. | 299/5 |

FOREIGN PATENT DOCUMENTS

| | | |
|---|---|---|
| CN | 1048564 A | 1/1991 |
| CN | 1186898 A | 7/1998 |

(Continued)

*Primary Examiner* — John Kreck
(74) *Attorney, Agent, or Firm* — Hammer & Associates, P.C.

(57) ABSTRACT

A liquid collection process with liquid guiding holes for in-situ leaching an ore body to extract rare earth elements, including: 1) multiple liquid collection channels are provided in an ore body; 2) liquid guiding holes are arranged near the bottom and on both sides of the channels, and these holes and the channels jointly constitute a multi-channel mother liquid drainage and collection control network; 3) a blocking wall is provided in the channels, a front lower part of the wall is connected to a channel outlet by a conduit controlled with a ball valve switch at the outlet; 4) a multi-channel mother liquid collection network of liquid collection engineering control system is finally formed through the alternate operation of pressure release and increase. The process reduces the loss rate of mother liquid, reduces environmental pollution, and improves the recovery rate of rare earth elements.

10 Claims, 1 Drawing Sheet

(56) References Cited

FOREIGN PATENT DOCUMENTS

| | | | |
|---|---|---|---|
| CN | 1401797 | A | 3/2003 |
| CN | 1847615 | A | 10/2006 |
| CN | 101936166 | A | 1/2011 |
| CN | 201802378 | U | 4/2011 |
| RU | 2067169 | C1 | 9/1996 |
| SU | 1153046 | A | 4/1985 |

* cited by examiner

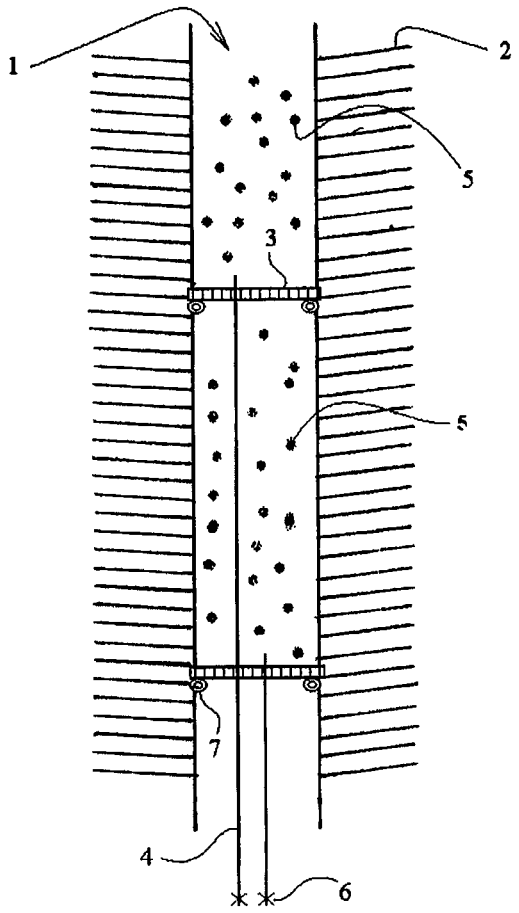
1
2
5
3
5
7
4
6

LIQUID COLLECTION PROCESS WITH LIQUID GUIDING HOLES FOR IN-SITU LEACHING AN ORE BODY TO EXTRACT RARE EARTH ELEMENTS

FIELD OF THE INVENTION

The present invention relates to the technical field of mining, especially relates to an in-situ liquid collection process, in particular to, to a liquid collection process with liquid guiding holes for in-situ leaching an ore body to extract ion adsorption type rare earth.

The terminology "liquid guiding holes" appearing in this specification is an idiom in this field, referring to various liquid guiding path, channels, tubes, or pipes in an appropriate length.

PRIOR ART

In the prior art, there are mainly two kinds of in-situ leaching and liquid recovery technology for of adsorption type rare earth.

The first kind of liquid recovery technology uses an artificial false bottom to take closure of a mother liquid for recovery. This technology adopts the liquid collection channel and its closure holes, and uses a cement slurry to provide a liquid recovery network with anti-seepage treatment, so as to set up an artificial mother liquid collection system. However, such a mother liquid recovery system has some obvious deficiencies. Firstly, the anti-seepage treatment of closure holes often results in blocking the closure holes; the impermeable materials often unfortunately do anti-seepage treatment for the upper half side walls and top walls of the closure holes, thus hinder the normal collection of mother liquid and increase the loss rate of mother liquid. Secondly, the closure holes cannot perfectly prevent from the infiltration of mother liquid. Finally, this mother liquid collection system cannot effectively reduce a loss rate of the non-mineral liquid and the rare earth mother liquid, which is unfavorable to the recovery of the rare earth mother liquid, thus reduces the rare earth recovery rate, hinders improvement of rare earth recovery rate, and certainly brings with environmental pollution.

The second kind of liquid recovery technology is to inject water into the lean ore formation or dead ground to saturation, so as to form an artificial water seal base plate. The most obvious defects of artificial water seal base plate include an excessive long construction time, a too long time to wait for mother liquid collecting, and a low mother liquid concentration, while the artificial water seal base plate cannot be used for all geological structure and is difficult to keep enough stability of mountain side slope. Therefore, the artificial water seal base plate is rarely used in the practical mining activities.

SUMMARY OF THE INVENTION

The object of the present invention is to provide a liquid collection process with liquid guiding holes for in-situ leaching an ore body to extract rare earth, which can reduce the loss rate of the mother liquid, facilitate the recovery of rare earth mother liquid, reduce environmental pollution, and improve the recovery rate of rare earth.

Thus, the present invention provides a liquid collection process with liquid guiding holes for in-situ leaching an ore body to extract rare earth, characterized in that:

1) multiple liquid collection channels are constructed in the ore body;

2) the liquid guiding holes are further constructed on both sides of the liquid collection channels, so a multi-channel mother liquid drainage and liquid recovery engineering network is formed to at least include the liquid collection channels and the liquid guiding holes;

3) blocking walls are provided along the liquid collection channels, the front lower parts of the blocking walls are communicate with a liquid collection channel outlet through conduits, and the conduits are controlled with ball valve switches at the outlet; and 4) in the measurement and production, through the changes of the pressure gradient, high and low pressure gradient areas are formed between the above ore body and the below engineering control network, and finally the multi-channel mother liquid collection engineering system is formed.

In the present invention, the liquid collection channels is located according to the ore body grade at any single exploratory well, a distribution of ore body grades, and the principle of hydraulics. The positions of the liquid collection channels are determined according to the following principle:

1) the bottom of the liquid collection channels is located at a level of 0.015-0.02% thickness above the bottom of ore body;

2) the liquid collection channels are arranged along a profile of the mountain; and/or 3) the positions of the liquid collection channels are preferably arranged to pass through where the ore bodies are with good grade, then, liquid guiding holes are arranged to near the bottom of the liquid collection channels, and are provided on both sides of the liquid collection channels, and the liquid guiding holes and the liquid collection channels joint form the multi-channel mother liquid drainage and liquid recovery control engineering network.

A plurality of blocking walls are provided in the liquid collection channels. These blocking walls are impermeable walls embedded into the periphery of the channels to prevent the non-mineral liquid from flowing out, and make the non-mineral liquid infiltrate below the engineering network (or called as a control surface). In the front and back of the blocking walls, supporting pillars are constructed to prevent the channels from collapse. In the working network, in a direction to the liquid collection outlet, blocking are set up at interval of about 20 m, until the last blocking wall is 10 m away from the outlet. Multiple blocking walls can be provided. The positions of the blocking walls can be arranged in front of the channel supporting pillars and to be adjacent to them, so that the blocking walls can be protected against collapse. The blocking walls can be provided by laying common bricks into surrounding channels.

Before the blocking walls, there is filled with anti-blocking material, and the lower part of the blocking walls is connected to the liquid collection outlet by means of conduits. It is also necessary to provide sufficient anti-blocking measures for the channels and conduits. The conduits are controlled with the ball valve switches at the outlet. The ball valve switches are used to detect if there is any mother liquid. In operations, through increase and release of pressure, high and low pressure gradient areas are formed between the above bore body and the below engineering control surface, and finally a multi-path mother liquid recovery control engineering system is formed. The multi-path mother liquid recovery control engineering system and the lean ore formation or dead ground with an increased water content ratio jointly form a mother liquid collection control system. The main purpose of the conduits at the front lower parts of the blocking walls controlled with the ball valve switches at the outlet is to control the infiltration of the non-mineral liquid and the collection of mother liquid. The anti-blocking material may be firewood. The conduits can be plastic or PVC pipe.

In the production, it is necessary to make daily inspection to check whether there is any mother liquid in the conduits and release the non-mineral liquid, in order to drive the non-mineral liquid below the engineering control surface as much as possible, and thus reduce the infiltration of the mother liquid downward through the engineering control surface; through alternate changes of the pressure in the ore earth between channels, form a multi-channel mother liquid recovery engineering control system. When mother liquid appears, it is required to open the ball valve switches, so that the multi-channel liquid collection channels and the lean ore formation or dead ground with the saturated water content jointly form a mother liquid collection system. If there is no mother liquid, it is required to close the ball valves. The times of daily inspection should be controlled in a flexible manner according to the characteristics of the non-mineral liquid, for example at most once per day. After inspection for many times, a multi-channel mother liquid recovery control network is finally formed, and this control network and the saturated or nearly saturated water seal surface below it jointly form a water sealed, multi-channel mother liquid drainage and mother liquid collection system with high pressure gradient.

Preferably, 2-3 primary liquid collection channels are mainly arranged along the profile nor contour of the mountain, to pass through high grade ore bodies as much as possible. These channels are designed to have a gentle gradient of 1-2°, so as to facilitate the infiltration of the non-mineral liquid.

Preferably, the multiple liquid collection channels are arranged in parallel at interval of about 20 m.

More preferably, these liquid collection channels have such a trapezoidal section with lower bottom width of 1.2 m, upper bottom width of 0.7 m, and height of 1.7 m.

Preferably, the bottom and the lower half of side walls of the liquid collection channels are provided with anti-seepage treatment by means of a dilute cement slurry.

Preferably, the liquid guiding holes are arranged nearby the bottom of the liquid collection channels, the length of the liquid guiding holes is about 12 m, and are distributed on both sides of the liquid collection channels with a gradient of 1-2°, and 1-6 liquid guiding holes are provided per meter.

Preferably, the lower half of side walls of the liquid guiding holes is provided with anti-seepage treatment by means of a dilute cement slurry.

Preferably, in the front of the channel supporting pillars to be adjacent to them, the blocking walls are provided by laying common bricks into the periphery of the channels.

Preferably, the front of the blocking walls is filled with firewood, and their lower parts are connected to the outlet by means of a 1.5" inner diameter of plastic coil or PVC pipes.

Preferably, in the measurement and production, the ball valve switches are opened and closed for many times, to form a decreased/increased pressure gradient between the below engineering control surface and the above ore earth; through the increase and decrease of pressure, high and low pressure gradient areas are formed between the above ore body and the below engineering control surface, and a water sealed, multi-channel mother liquid collection system with high pressure gradient is finally formed.

The present invention effectively uses a non-mineral liquid in the in-situ leaching of ion adsorption type rare earth. About 15% water content is contained in the granite weathering crust or volcanic tuff ion adsorption type rare earth. In the process of grouting in in-situ leaching in a static pressure, the water content (called "non-mineral liquid") is firstly driven out. This process allows most of the non-mineral liquid (about more than 80%) to infiltrate into the lean ore if and the dead ground; furthermore, through the alternate operations to decrease and increase the pressure gradients between the below liquid recovery engineering control surface and the above ore earth, a multi-channel mother liquid drainage and liquid recovery control surface is formed. This invention can increase the water content of the lean ore formation and dead ground, hinder the rare earth mother liquid to infiltrate downward, reduce the consumption of leaching agent, and reduce the loss rate of mother liquid. The multi-channel mother liquid recovery control surface formed by the present invention can facilitate the recovery of the rare earth mother liquid and reduce the environmental pollution. It has been proved by both theory and practice that, the rare earth resource recovery rate is improved by more than 10% according to the present invention, namely the rare earth recovery rate is improved.

DESCRIPTION OF ACCOMPANYING DRAWINGS

FIG. 1 is a top view of the liquid collection channels of the present invention, in which the liquid collection channels are connected with the liquid guiding holes.

DETAILED DESCRIPTION OF PREFERRED EMBODIMENTS

With reference to the FIG. 1, an embodiment of the present invention is described as follows: According to the rare earth grade distribution of ore bodies as well as the principle of hydraulics, at the height of 0.015%-0.02% of thickness of the ore bodies above the bottom of ore bodies, the primary liquid collection channels 1 are arranged along the outline of inclination of the mountain, and the liquid collection channels 1 are so arranged to pass through high grade ore bodies as much as possible. These channels 1 have a gentle gradient of 1-2°. The liquid guiding holes 2 are arranged nearby the bottom of the liquid collection channels, the length of the liquid guiding holes is about 12 m, and are distributed on both sides of the liquid collection channels with a gradient of 1-2°, and 1-6 liquid guiding holes are provided per meter. It is feasible to make a cement slurry anti seepage treatment at the bottom of the liquid collection channels 1 and the liquid guiding holes 2. It is feasible to set up multiple supporting pillars 7 at both side walls of the liquid collection channels 1. After the construction of the liquid collection channels 1, a blocking wall 3 is built before a nearby supporting pillar 7 at interval of about 20 m, so as to divide the liquid collection channels 1 into several segments. The bottom of each blocking wall 3 is connected to the outlet by means of coil pipe or PVC pipe 4 to collect the mother liquid. Each segment of liquid collection channels 1, which is separated by the blocking walls 3, is provided with one coil pipe or PVC pipe 4 that is connected to the outlet. The channels in the front of the blocking walls 3 (the side kept away from the ball valves 6) are filled with anti-blocking firewood 5 for anti-blocking treatment. Ball valve switches 6 are connected at the outlet of the coil pipe or PVC pipe 4. In the measurement or production, the non-mineral liquid is driven to infiltrate downward along the control surface formed by the liquid collection channels 1 and the liquid guiding holes 2. Only when there is the mother liquid, the liquid recovery system begins to work. Through the release of pressure, high pressure gradient is formed between the above ore body and the below engineering control surface, and finally a multi-channel mother liquid collection engineering system is formed. This multi-channel mother liquid collection engineering system and the lean ore formation or dead ground with saturated water content jointly form a mother liquid collection system.

The invention claimed is:

1. A liquid collection process with liquid guiding holes for in-situ leaching an ore body to extract rare earth elements, characterized in that said process includes:

1) forming liquid collection channels in the ore body;
2) forming a plurality of liquid guiding holes with a slope or gradient of 1-2° close to a bottom of each liquid collection channel on both sides of the liquid collection channel, so that a mother liquid drainage and collection network is formed by the liquid collection channel and its liquid guiding holes;
3) forming blocking walls inside and along the liquid collection channel, in which a lower part of each blocking wall communicates with a channel outlet by means of a conduit, and the conduit is controlled with a ball valve switch at the outlet; and
4) adjusting pressure inside the liquid collection channel by means of the ball valve switch, so as to obtain a pressure gradient between the ore body above the mother liquid drainage and collection network and the mother liquid drainage and collection network itself, so that a multi-channel mother liquid collection system is finally formed, wherein a non-mineral liquid is driven to infiltrate downward into each liquid collection channel and its liquid guiding holes, the mother liquid drainage and collection network works only after a mother liquid is formed.

2. The liquid collection process of claim 1, characterized in that, the liquid collection channels are located according to the following principles:

1) the bottom of each liquid collection channel is located to be over the bottom of the ore body with 0.015-0.02% of thickness of the ore body; and/or
2) each liquid collection channel is arranged along surface profile of the mountain body; and/or
3) each liquid collection channel is arranged to pass through any ore body with rare earth elements.

3. The liquid collection process of claim 1, characterized in that, the liquid collection channels are 2-3 parallel channels which are arranged with an interval of about 20 m along the contour or inclination of the mountain.

4. The liquid collection process of claim 1, characterized in that, at a front of each blocking wall, the liquid collection channel is filled with firewood for anti-blocking.

5. The liquid collection process of claim 1, characterized in that, the bottom and a lower half of side walls of the liquid collection channels are provided with a dilute cement slurry to prevent seepage.

6. The liquid collection process of claim 1, characterized in that, the blocking walls are impermeable walls embedded into the periphery of each liquid collection channel, and a front and back of the blocking walls are constructed to prevent each liquid collection channel from collapse.

7. The liquid collection process of claim 1, characterized in that, the conduit at the lower part of the blocking walls is extended to the channel outlet where a ball valve switch is used to control the infiltration of the non-mineral liquid and the collection of the mother liquid.

8. The liquid collection process of claim 1, characterized in that, the ball valve switch opens/closes many times, to make a decreased/increased pressure gradient between the ore earth above the mother liquid drainage and collection network and the mother liquid drainage and collection network itself, and finally a multi-channel mother liquid collection system with high pressure gradient is formed.

9. The liquid collection process of claim 1, characterized in that, the liquid guiding holes, each of which has a length of about 12 m, are distributed with 1-6 liquid guiding holes per meter on both sides of each liquid collection channel.

10. The liquid collection process of claim 1, characterized in that, a lower half of side walls of the liquid guiding holes is provided with a dilute cement slurry to prevent seepage.

* * * * *